US005580397A

United States Patent [19]

Meyer et al.

[11] Patent Number: 5,580,397

[45] Date of Patent: Dec. 3, 1996

[54] CARBIDE AND CARBONITRIDE SURFACE TREATMENT METHOD FOR REFRACTORY METALS

[75] Inventors: Glenn A. Meyer, Danville; Marcus A. Schildbach, Livermore, both of Calif.

[73] Assignee: The United States of America as represented by the Department of Energy, Washington, D.C.

[21] Appl. No.: 381,480

[22] Filed: Jan. 26, 1995

[51] Int. Cl.[6] ..... C23C 8/20

[52] U.S. Cl. ..... 148/218; 148/238

[58] Field of Search ..... 148/237, 278, 148/218

[56] References Cited

U.S. PATENT DOCUMENTS

| | | | |
|---|---|---|---|
| 2,892,743 | 6/1950 | Griest | 148/237 |
| 3,266,948 | 8/1966 | McQuine | 148/237 |
| 3,421,953 | 1/1969 | McQuine | 148/237 |
| 4,150,905 | 4/1979 | Kaplan . | |
| 4,433,170 | 2/1984 | Stern . | |
| 4,935,073 | 6/1990 | Bartlett | 148/278 |
| 5,232,522 | 8/1993 | Doktyez | 148/237 |

FOREIGN PATENT DOCUMENTS

| | | | |
|---|---|---|---|
| 2415553 | 10/1975 | Germany | 148/237 |
| 1742353 | 6/1992 | U.S.S.R. | 148/237 |

OTHER PUBLICATIONS

Schrager Elemntary Metallurgy and Metallaography pp. 175 et. seq.

Brooks Principles of Surface Treatment of Steels pp. 67 et seq.

American Society for Metals Carburizing and Carbonitriding.

Krauss Carburizing Process and Performance.

Horz & Linenmaier The Kinetics and Mechanisms . . . Jrnl of Less Common Metals 35 (1974) pp. 88–95.

Andelin, Kirkbride & Perkins High Temperature . . . Los Alamos NL Report LA 3631 (1967).

*Primary Examiner*—Sam Silverberg

*Attorney, Agent, or Firm*—Virginia B. Caress; William C. Daubenspeck; William R. Moser

[57] ABSTRACT

A carbide and carbonitride surface treatment method for refractory metals is provided, in steps including, heating a part formed of boron, chromium, hafnium, molybdenum, niobium, tantalum, titanium, tungsten or zirconium, or alloys thereof, in an evacuated chamber and then introducing reaction gases including nitrogen and hydrogen, either in elemental or water vapor form, which react with a source of elemental carbon to form carbon-containing gaseous reactants which then react with the metal part to form the desired surface layer. Apparatus for practicing the method is also provided, in the form of a carbide and carbonitride surface treatment system (10) including a reaction chamber (14), a source of elemental carbon (17), a heating subassembly (20) and a source of reaction gases (23). Alternative methods of providing the elemental carbon (17) and the reaction gases (23) are provided, as well as methods of supporting the metal part (12), evacuating the chamber (14) with a vacuum subassembly (18) and heating all of the components to the desired temperature.

14 Claims, 5 Drawing Sheets

CARBIDE AND CARBONITRIDE SURFACE TREATMENT METHOD FOR REFRACTORY METALS

The United States Government has rights in this invention pursuant to Contract No. W-7405-ENG-48 between the United States Department of Energy and the University of California.

TECHNICAL FIELD

This invention relates generally to metallurgical processes and more particularly to processes for applying hardening layers to the exterior of metal items.

BACKGROUND ART

It has long been known that the introduction of surface "impurities" into metals can have beneficial effects. Surface hardening, as it is known in many references, can be utilized to provide a hard surface which is resistant to wear, corrosion and abrasion while retaining the ductile interior composition of the metal part and retain resistance to fracture and the like. It is desirable to utilize surface hardening techniques in a variety of applications, particularly with respect to parts which are exposed to abrasion and/or caustic and high temperature environments.

The most common example of surface treatment of metals, which has been known for many decades, is in providing a surface hardening to steel. This method, which is typically known as carburizing, is utilized to embed atomic carbon into the metallic matrix of the steel component near the surface. Typically, the surface penetration is every limited, with the usual penetration being in the range of 0.1 cm or less. The absorption of carbon into the steel surface is well known and has been described in a variety of metallurgical references, including *Elementary, Metallurgy and Metallography*, by Arthur M. Shrager, Dover Publications Inc., at pages 175 et seq.; in *Principles Of The Surface Treatment Of Steels,* by Charlie R. Brooks, Technomic Publishing Company Inc., at pages 67 et seq., in *Carburizing and Carbonitriding*, by American Society for Metals 1977, and in *Carburizing Process and Performance*, edited by George Krauss, ASM International 1989.

Carburizing of steel is typically conducted in either a gaseous atmosphere (gas carburizing), a carbon powder bed (pack carburizing), or a molten salt bath containing carbon (liquid carburizing). The primary carbon transport species for these processes is carbon monoxide.

Gas carburizing involves exposing steel to a gas mixture containing carbon monoxide (CO), hydrogen gas (typically methane ($CH_4$) hydrogen ($H_2$), and Nitrogen ($N_2$). The carbon monoxide, hydrogen, and methane react with the surface of the steel allowing the dissolution of carbon. The reactions which are directly responsible for carbon deposition are:

$$Fe+2CO=Fe(C)+CO_2$$

$$Fe+CH_4=Fe(C)+2H_2$$

$$Fe+CO+H_2=FE(C)+H_2O.$$

In addition to providing carbon directly, methane also reduces the partial pressures of $CO_2$ and $H_2O$, both of which decarburize steel, in the reaction vessel. This occurs via the reactions:

$$CH_4+CO_2=2CO+2H_2$$

$$CH_4+H_2O=CO+3H_2.$$

Nitrogen acts as an inert carrier gas. Typical gas carburizing process temperatures are in the range of 850° to 950° C.

Pack bed carburizing involves covering the steep with finely divided carbon powder and heating to 800° to 1100° C. Carbon monoxide gas formed by the decomposition of the carbon powder transports the carbon to the surface of the steel.

The liquid carburizing process uses a high temperature (900° C.) molten salt bath containing carbon powder. The reaction of the molten carbonate and the carbon produces carbon monoxide which is transported to the surface of the steel.

When performing on steels, carbonizing is a modified form of gas carburizing. The steel is exposed to an atmosphere containing both carbon and nitrogen at temperatures of 700° to 900° C.; where both the carbon and nitrogen are absorbed into the steel simultaneously. Ammonia ($NH_3$) is introduced to the gas carburizing atmosphere to add nitrogen to the metal being processed. Liquid carbonitriding is also performed using cyanides (sodium cyanide) in a molten salt bath.

Refractory metals are typically carburized in hydrocarbon gas environments (G. Horz and K. Lindenmaier, "The Kinetics and Mechanisms of the Absorption of Carbon by Niobium and Tantalum in a Methane or Acetylene Stream," Journal of the Less Common Metals, 35 (1974), pp. 88–95). They are processed differently from steels because they tend to form oxides, rather than carbides, when exposed to carbon monoxide. Oxide formation passivates the surface, preventing further carbon absorption. This behavior is also seen in steel containing significant quantities of chronium and silicon. Since refractory metals have a high affinity for oxygen, they are usually carburized and carbonitrided in vacuum furnaces.

Pack carburizing has also been performed on refractory metals (R. L. Andelin, L. D. Kirkbride, and R. H. Perkins, "High-Temperature Environmental Testing of Liquid Plutonium Fuels," Los Alamos National Laboratory Report LA-3631, 1967).In this work, refractory metal tubes were packed with carbon granules, heated in vacuum to 1700° C. and then filled with hydrogen. After five minutes, the hydrogen was pumped out and the tube cooled to room temperature in helium. Hydrogen is introduced so that it may react with the carbon and produce hydrocarbons. The hydrocarbons then react with the metal to produce a carbide.

There are also methods used to carbonitride refractory metals. The parts are placed in a pure carbon bed and heated in a nitrogen atmosphere at temperatures in the range of 1200° to 1600° C. It was believed that some of the carbon in contact with the metal was able to diffuse into the metal at the same time that nitrogen was absorbed from the gas phase.

Two methods of applying a carbide coating are described in U.S. Pat. No. 4,150,905, issued Apr. 24, 1979 to Kaplan et al. and U.S. Pat. No. 4,430,170, issued Feb. 7, 1984 to Stern. These references include a discussion of the problems and purposes of the coating technology and also describe some of the previous attempts at accomplishing this. The Kaplan reference describes a method of applying vapor depositions of a separate layer of material on the exterior of a ball shaped element, particularly the ball for a ball point pen. The method is shown as being particularly intended for a deposition of a layer of tungsten carbide on the exterior of a ball formed of tungsten or a variety of other materials.

The Stern patent utilizes an electro deposition technique with an alkali fluoride melt acting as the electrolyte. In such a case, a deposit of a layer of metal carbide can be applied to a desired thickness on any of a variety of appropriate materials. The Stern reference describes successful efforts with a variety of refractory metals, including results showing less success with respect to chromium.

Accordingly, much room for improvement remains in the art with respect to surface treatment for refractory metals in order to provide strong integral abrasion and corrosion resistant surfaces while avoiding contamination of the properties of the item itself. A strong need remains for metallic parts formed from refractory metals which are provided with such types of surfaces.

SUMMARY OF THE INVENTION

Accordingly, it is an object of the present invention to provide a process for forming carbide and carbonitride surface regions on parts made from refractory metals.

It is another object of the present invention to provide a method for maximizing "coating" quality while minimizing process cost.

It is a further object of the present invention to provide a method for providing a surface treatments for refractory metals with improved process control for achieving predictable effects.

It is yet another object of the present invention to provide carbide, nitride and carbonitride surface treatment utilizing single apparatus configurations.

Briefly, the preferred embodiment of the present invention is a process for providing surface treatment to refractory metals in order to improve abrasion and corrosion resistance. The method is specifically addressed to refractory metal materials including those formed of boron, chromium, hafnium, molybdenum, niobium, tantalum, titanium, tungsten or zirconium or alloys of these materials. The usage is particularly adapted for providing surface treated parts for use in aerospace, automotive, petroleum and chemical processing components as well as for metal processing, tool & die, nuclear reactors and oxidation resistant refractory coatings.

The method is adapted for use in treating discrete components which are placed into a reaction chamber in which a vacuum or specific partial pressure of reaction gases may be maintained. The reaction chamber is heated to an appropriate temperature, usually in excess of 800° C., and a source of elemental carbon is provided. Process control is achieved by temperature modification and by adjustment of the gaseous mixture by separate control of sources nitrogen, hydrogen and/or water. Various reactor configurations can be utilized to achieve the surface treatment desired, depending on the nature of the components to be treated and the desired results.

An advantage of the present invention is that remote input control can be utilized to tailor specific surface treatment results by controlling the gas content in the reaction chamber.

Another advantage of the inventive method is that it does not require line of sight deposition and thus can be successfully used with irregularly shaped components.

It is a further advantage of the present invention that sensitive control mechanisms may be situated outside of the reaction chamber.

It is yet another advantage of the present invention that there is no requirement for heated molten materials or high temperature electrical contacts with respect to the component to be treated.

It is still a further advantage of the invention that carbide, nitride and carbonitride processing may be achieved in a desired depth pattern by process control.

These and other objects and advantages of the present invention will become clear to those skilled in the art in view of the description of the best presently known modes for carrying out the invention and the industrial applicability of the preferred embodiment as described herein and as illustrated in the several figures of the drawings.

BEST MODE OF CARRYING OUT THE INVENTION

Figure 1:
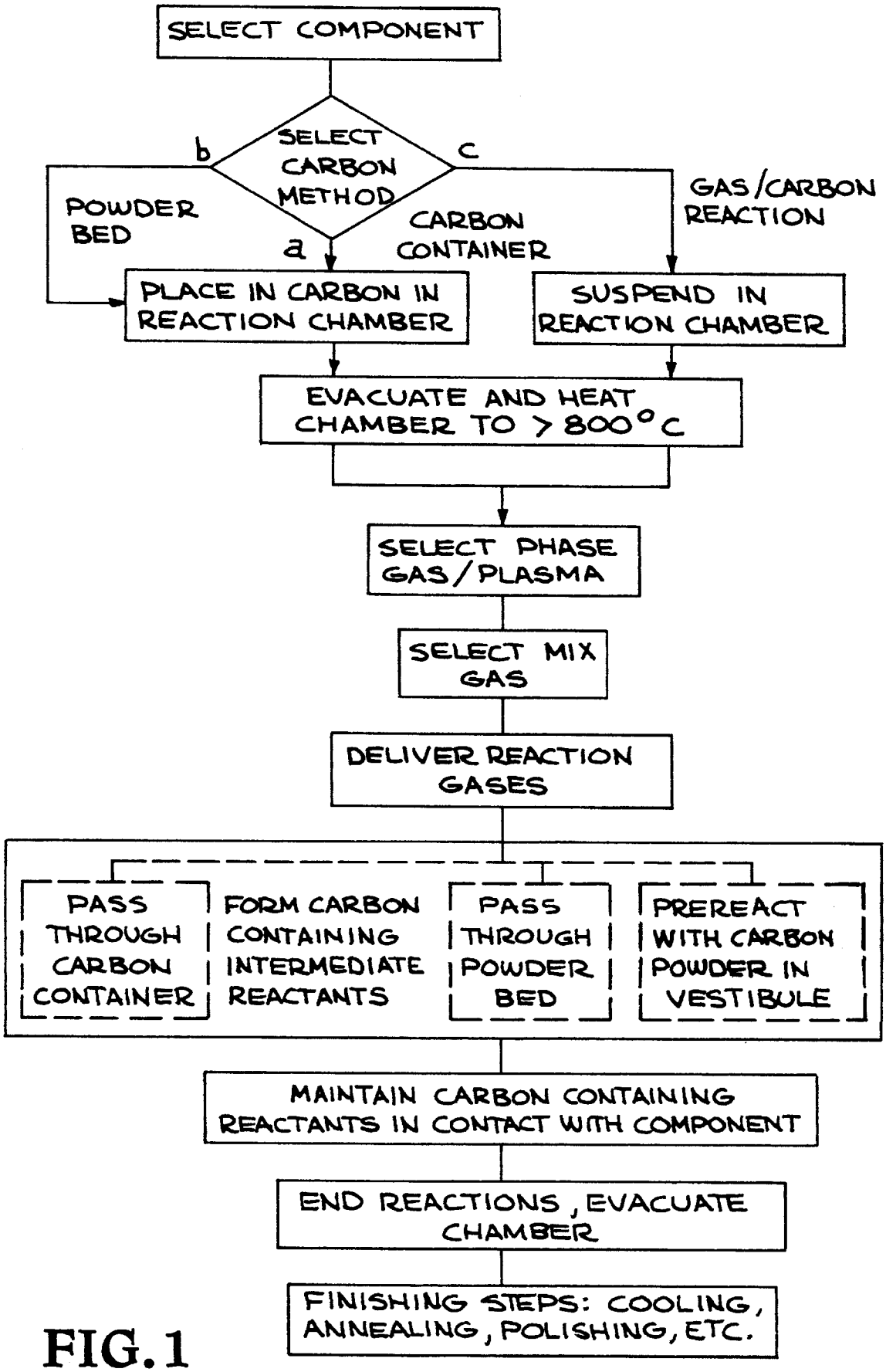
FIG. 1 is a flow chart representation of the process according to the present invention.

The best presently known mode of carrying out the invention is a process for surface treatment components formed of a variety of refractory metals. The surface treatment process, which is illustrated in schematic fashion in FIG. 1, is utilized to create a surface zone on the component in question. The surface region or zone, sometimes loosely referred to as a "coating", has the properties of being harder, more abrasion resistant and more corrosion resistant than the untreated metal surface. The process involves changing the properties of the metallic components in the vicinity of the surface by chemical treatment utilizing combinations of carbon, nitrogen, hydrogen and/or water.

As illustrated in FIG. 1, the first step in the process is that of selecting the particular component which is to be treated. For the purposes of this discussion, the component selected is a relatively small item such as a tool or a fitting which is irregular in shape. The component is understood to be constructed of a material which is generally known in the field as "refractory" and will be formed of boron, chromium, hafnium, molybdenum, niobium, tantalum, titanium, tungsten, or zirconium or alloys of these materials. These materials are particularly important in constructing strong, lightweight and high temperature resistant structures, such as are used in space exploration, nuclear processing, cutting tools, aerospace, automotive, petroleum and chemical processing components and other utilizations in which oxidation, chemical and abrasion resistant refractory parts are desired.

The second step involves selection of the method of provision of elemental carbon to the surface of the component parts. This selection, in the present invention, involves utilizing either a carbon container (discussed hereinafter with respect to FIG. 2); a powder bed (discussed hereinafter with respect to FIG. 3); or a gas process, where the process gas is prereacted with hot carbon, (discussed hereinafter with respect to FIG. 4). The choice of carbon provision method is somewhat dependent on the nature of the facilities available and the type of component part which is to be treated.

The part is then placed in reaction chamber in a manner in which the relevant surface area is exposed. This will differ slightly depending on the method of carbon provision provided, as is discussed hereinafter. However, it is important that the part be supported in such a way that the relevant surface area is not occluded so that the surface treatment may proceed relatively equally over the relevant surface area.

The next steps, which will be approximately the same in all cases, are to evacuate the reaction chamber and to heat the reaction materials to a desired temperature. The temperature involved may differ somewhat depending upon the carbon and gas phase method steps, and the particular composition of the metallic components, but is expected in all cases to be least in excess of 800° C. (approximately 1400° F.) The temperature is maintained until the contents of the reaction chamber have reached equilibrium at the desired temperature. The mechanisms for providing and maintaining the thermal energy are discussed hereinafter with respect to the physical structures.

The next step involved the selection of the manner of delivery of the reactive materials (gases). As used in this discussion, the term "gases" applies to the reaction materials which are ordinarily in a gas phase at the temperatures involved. These include hydrogen, nitrogen and water vapor. It is understood that the reference to each of these as being a "gas" may not be strictly accurate in all of the reaction mechanisms (in fact, in the mechanism associated with FIG. 5 some of these components are specifically intended to be in plasma phase) but the term "gas" is the best known choice of nomenclature to describe the component.

Figure 5:
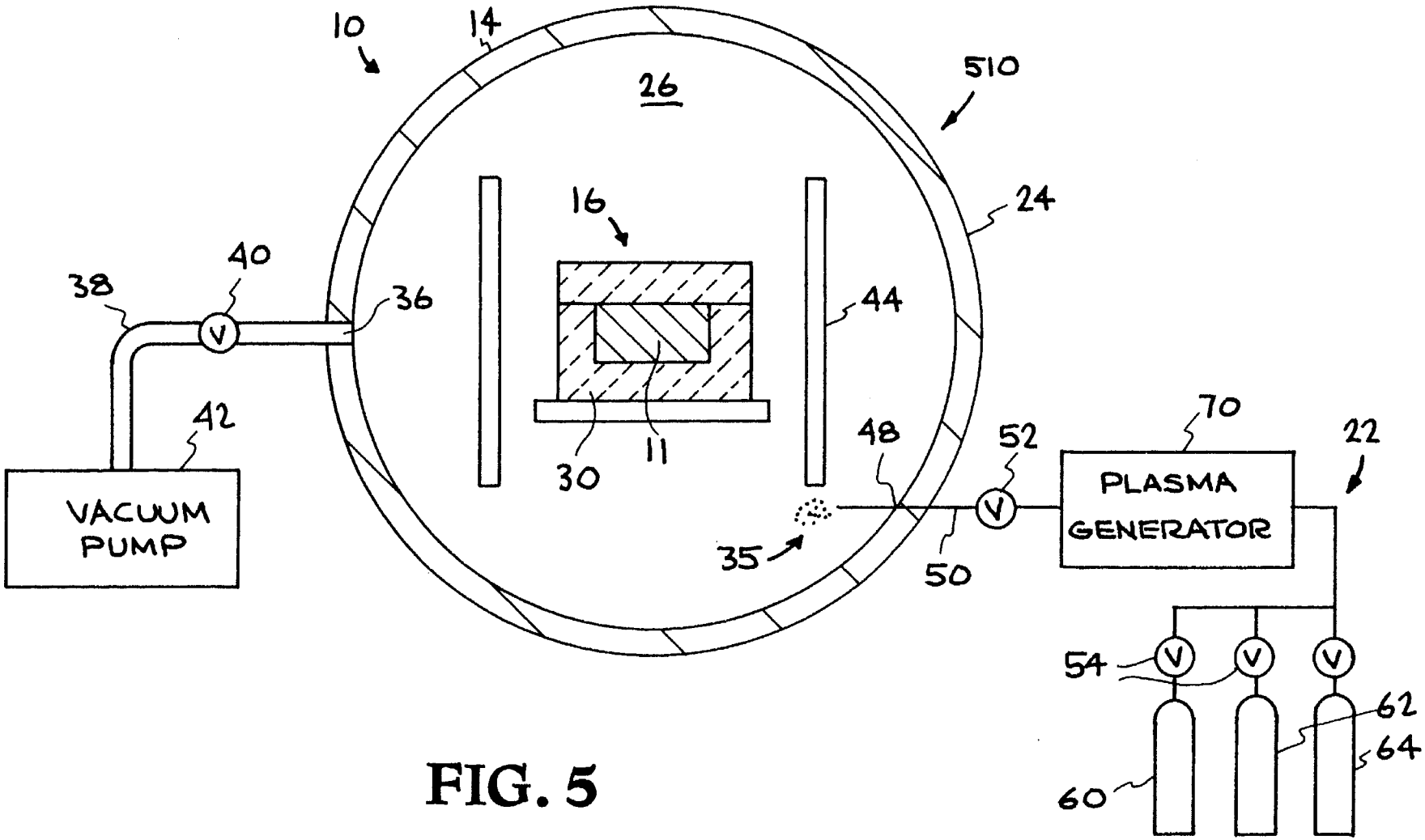
FIG. 5 illustrates a structure for third alternate method of performing the process, using elemental (plasma phase) reaction materials.

The gaseous delivery mechanism is somewhat dependent upon the carbon delivery mechanism and also on the nature of reaction desired in most of the reactions dealt with herein, with the exception of the plasma reaction illustrated in FIG. 5, it is assumed that the reaction gases are delivered in gas phase into the reaction chamber.

The next step in the method is the selection of the mix of gases which is desired at the given stage of the reaction. This involves the determination of the appropriate partial pressures of nitrogen, hydrogen and/or water in the reaction chamber. These reaction gases form intermediate carbon containing reactants with the elemental carbon. As discussed hereinafter, the adjustment of the partial pressures of these gases alters the predominance of various reactions with the metallic surface and either fosters or inhibits the surface treatment and the preferential creation of carbide, nitride and/or carbonitride surface layers.

The delivery of the reaction gases to the vicinity of the parts is accomplished once the desired mix is known. This will vary somewhat depending on the nature of the carbon delivery system and also depending upon whether a plasma creation system (see FIG. 5) is desired in a particular application. In all cases, however, an appropriate concentration of the reaction gases is delivered to the reaction vessel in the vicinity of the metallic component part and the concentration is maintained for a desired interval in order to react with the elemental carbon to form carbon containing reactants which then achieve the surface penetration desired.

Once the reactions have proceeded to a desired conclusion, the process is then completed by a collection of finishing sub-steps. These steps, which may be optional or may be performed in altered order, depending upon the nature of the metallic component selected, include cooling the part, removing from the reaction chamber, additional heating for annealing or similar purposes and possible quenching. In addition, once the part has been completed, additional milling or polishing may be desired in order to achieve surface uniformity and dimensional consistency.

The method of the present invention may be accomplished in a variety of ways utilizing a variety of physical structures. In each case, the structure may be referred to as a carbide and carbonitride surface treatment system, and referred to by the general reference character 10. The various embodiments of the carbide and carbonitride surface treatment system 10 are all adapted to provide a component metal part 11 with a surface layer (coating) 12 which is desired for abrasion or oxidation resistance or for other desired purposes.

Alternate embodiments of the surface treatment system 10 are illustrated in FIGS. 2 through 5, with some minor differences existing between the various embodiments. For the purposes of clarity and discussion, the various embodiments illustrated will be referred to as system 210 (FIG. 2); a system 310 (FIG. 3); system 410 (FIG. 4); and system 510 (FIG. 5), respectively. Components which are effectively identical throughout each of the embodiments will be referred to without a leading third digit. Components which may be specific to a single embodiment will be identified as being such.

Basically, each of the carbonitride surface treatment system 10 illustrated herein and utilized in the inventive method include a reaction chamber 14, a carbon source vessel 16 for providing an available supply of elemental carbon 17, a vacuum subassembly 18, a heating subassembly 20 and a gas subassembly 22 for providing a proper mix of reaction gases 23. These component subassemblies facilitate the process of providing the treatment layer 12 to the metallic part 11.

The reaction chamber 14 may vary in shape and dimension depending upon the nature of the metallic parts 11 desired to be treated, and is not restricted by any particular configuration parameters. However, each of the reaction chamber 14 is expected to have an enclosing wall 24 which encloses an interior volume 26 in which the reactions will occur. The interior surface of the enclosing wall 24 is selected to be resistant to corrosion or breakdown with respect to the reactions which are occurring in the interior volume 26. For a particular reaction chamber 14, the interior of the enclosing wall 34 will be formed of stainless steel.

The reaction chamber 14 will also be provided with some variety of a support structure 28 which supports the interior components, including the metal part 11, whether directly or indirectly. The nature of the support structure 26 will depend upon the nature of the part 11 and also on the carbon delivery system. The hanging support system 428 of FIG. 4 is one example, while the table structure 228 of FIG. 2 is another.

Figure 2:
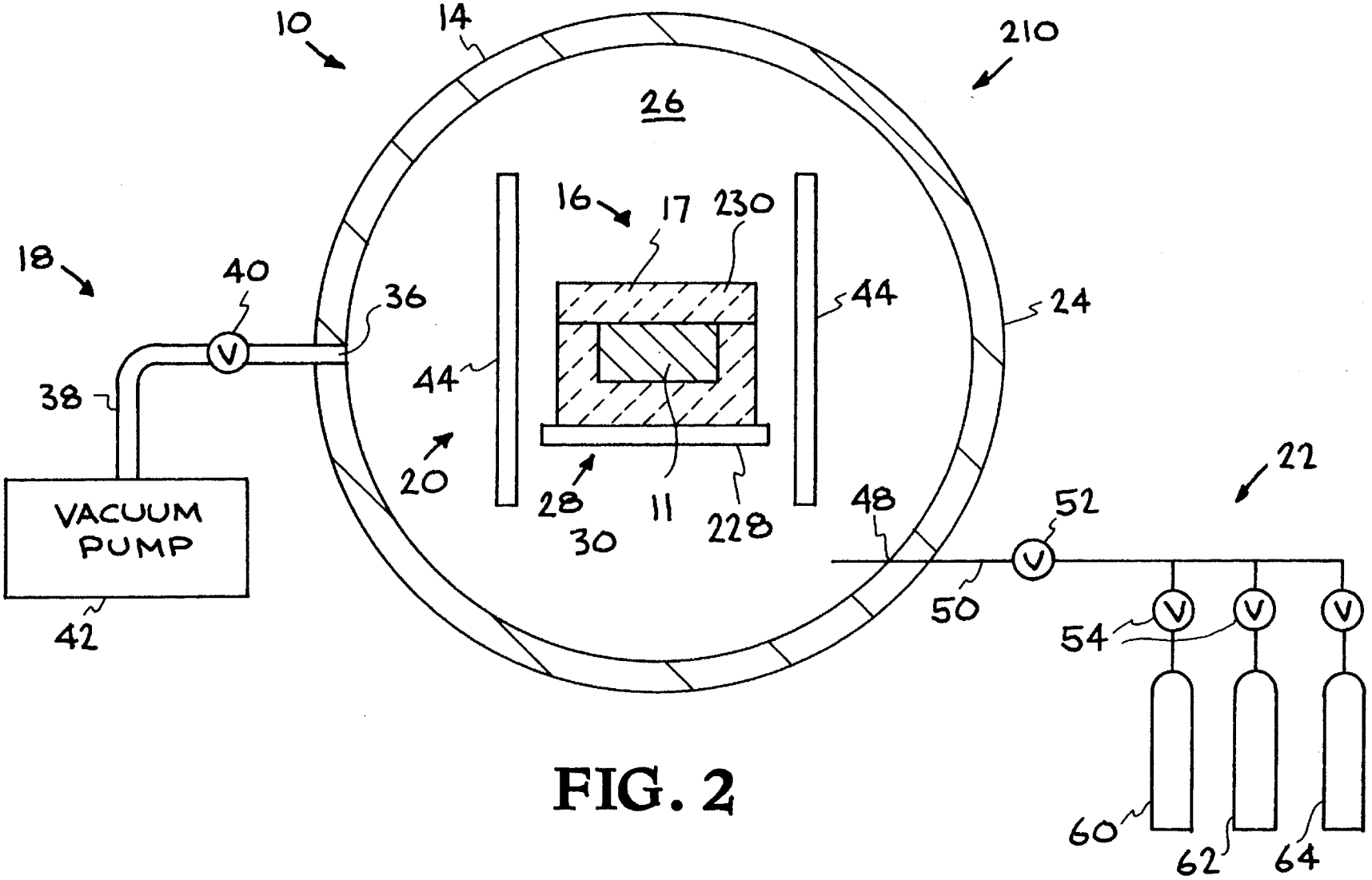
FIG. 2 is fanciful schematic illustration of a carbonitride surface treatment system according to a preferred embodiment of performing the inventive method.

As illustrated in FIG. 2, for system 210 the carbon source vessel 16 selected is in the form of an enclosed graphite container 30. The graphite container 30 in this case is essentially a box formed out of graphite. The graphite provides an adequate surface area of elemental carbon which is free to react with the reaction gases 23 and to be transferred to the surface layer on the metal part 11. The container should generally fit the contours of the metal part 11 in order to allow maximum proximity of the graphite source to the surface of the metal item 11, but it is not critical that physical contact be maintained.

Figure 3:
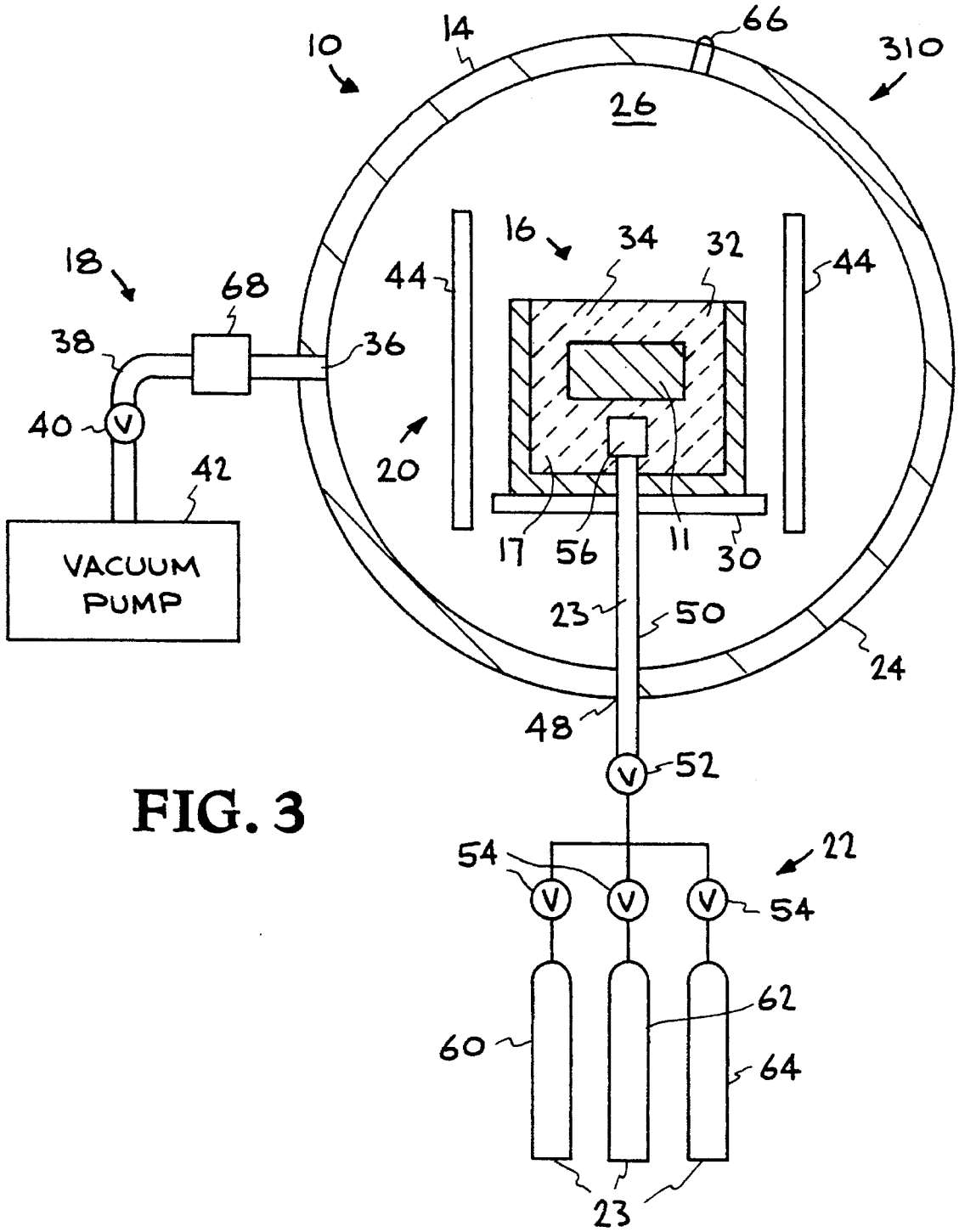
FIG. 3 illustrates, in the same manner as FIG. 2, an apparatus for an alternate method of providing elemental carbon to be exposed to reaction materials.

In FIG. 3, the source of elemental carbon 17 for the system 310 is in the form of a carbon powder 32 which is maintained within a graphite container 30. The powdered carbon 32, in the form of carbon black or small particle graphite, is disposed within a powder bed 34 in which the metallic part 11 is placed, with the remainder of the graphite container 30 being filled to completely cover the metal part 11. This method has the advantage of facilitating very close physical proximity between the carbon source and the surface of the metallic item during processing and also of maximizing the surface area of available carbon. This speeds the process and is believed to lead to even treatment of the entire surface.

Figure 4:
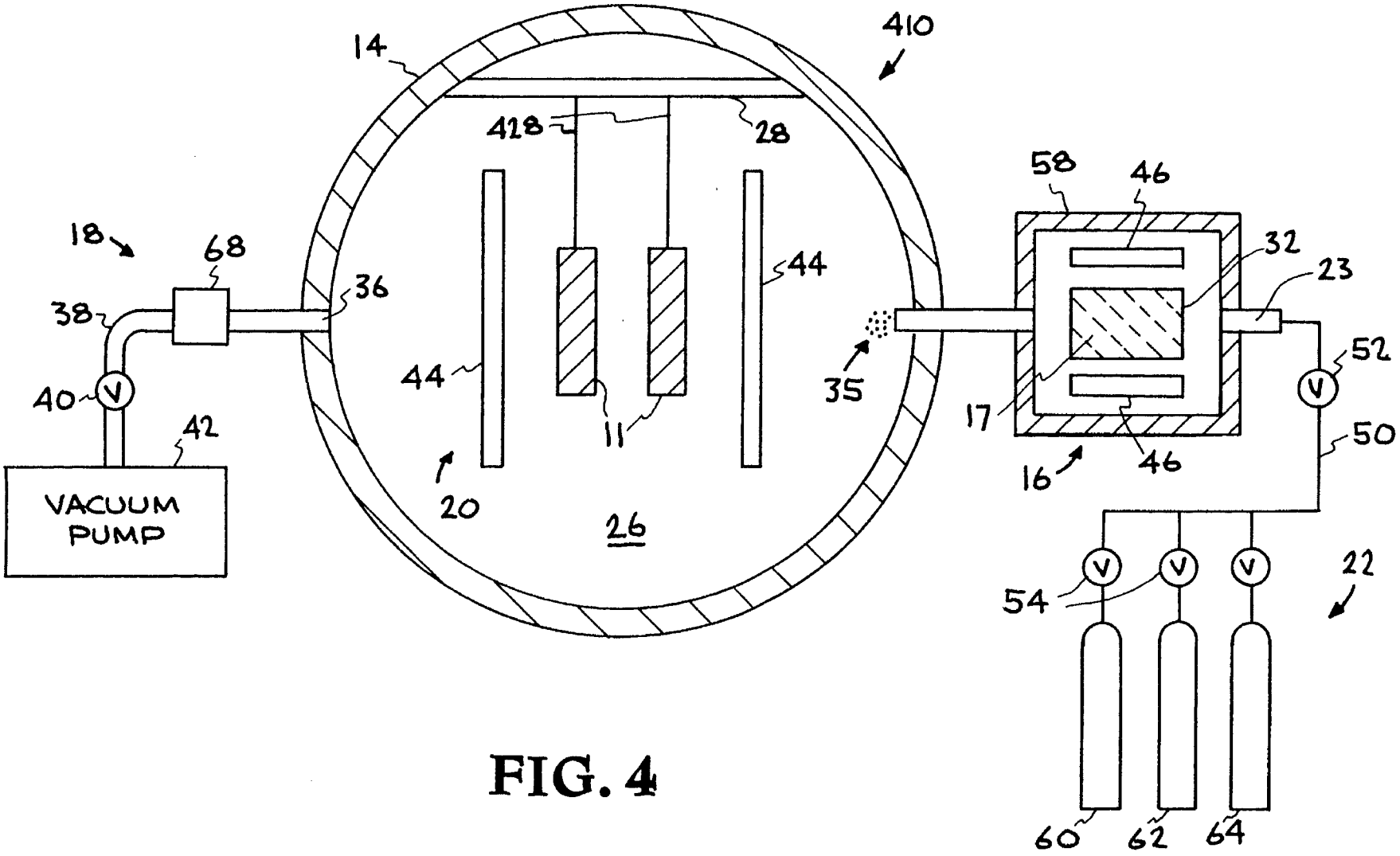
FIG. 4 illustrates a system for a second alternate method of providing elemental carbon.

The system 410 for accomplishing the inventive method, as shown in FIG. 4, utilizes a carbon bed to prereact the process gases 23 ($N_2$, $H_2$, and/or $H_2O$) with elemental carbon 17 to form carbon containing intermediate reactant species 35. As is shown in this illustration, the carbon powder 32 is maintain in a preheated powder bed 34 where it reacts with the process gases 23 before they enter the interior volume 26. The metal parts 11 may then be suspended within a reaction chamber 14 a manner in on the support structure 428 in which the carbon-containing reactants 35 may react with the component 11 to form the appropriate surface layer.

Although the carbon provision system 516 (essentially identical to that of FIG. 2) utilizing a graphite container 30 is illustrated in FIG. 5 as being appropriate for use with the plasma system, it is understood that the other methods would also be appropriate for this.

Each of the embodiments 10 is provided with some form of vacuum subassembly 18 which is very similar from embodiment to embodiment. Referring, for example, to FIG. 3, a vacuum port 36 is provided in the enclosing wall 24, thereby providing access to the interior volume 26 of the reaction chamber 14. The vacuum port 36 is then connected via a vacuum line 38, including a vacuum valve 40, to a vacuum pump 42. These conventional structures are utilized to evacuate the interior volume 26 prior to the reaction. Adjustment of the vacuum valve 40 may also be utilized to maintain the appropriate overall pressure in the interior volume 26, once the influx of reaction gases 23 and carbon-containing reactants 35 has begun.

A further common feature of the various embodiments of the apparatus is the heating subassembly 20. This will vary somewhat depending on the method of carbon provision selected, but will have the same purposes of heating the components and maintaining thermal equilibrium in order to facilitate the reaction mechanisms.

In FIGS. 2 and 3, it may be seen that interior heater 44 is provided in the interior volume 26 in order to heat the graphite container 30 and its contents, including the metal item 11. The method of surface treating the items 11 has been found to operate best when the metal part 11 is heated to a uniform temperature prior to the beginning of the reaction. The same is true for the elemental carbon 17. In FIG. 4, the interior heater elements 44 heat only parts 11 and the volume, since the carbon source 16 is situated outside of the chamber 414.

In FIG. 4, it may be seen that a separate powder heater 46 is provided for the external carbon powder bed 34. The powder heater 46 is adapted to heat the elemental carbon 17 in the powder bed 34 to appropriate temperature prior to introduction of the reaction gases 23.

Since the interior volume 26 will ordinarily be evacuated before or during the heating process, it is necessary that the interior heater 44 not depend on conduction or convection in order to heat the contents. Radiant heat provision is therefore desirable and the preferred nature of interior heater 44 is a molybdenum or carbon rod heater.

The gas subassembly 22 associated with the various embodiments will differ depending both upon the nature of the carbon source and upon the nature of the reactive gas provision desired. In each case, the object is to provide an appropriate mix of reaction gases 23 in a manner which allows reaction with the elemental carbon 17 to form an appropriate concentration of carbon-containing reactants 35 to further react with the surface of the metallic part 11.

Each of the embodiments will include a gas port 48 formed in the enclosing wall 24 in order to allow the provision of the reaction gases 23 to the interior volume 26. Various gases are provided via a gas line 50 and in most cases a common valve 52 will control the overall flow of the combined gases. The flow of the individual reaction gases is separately controlled by a source valve 54 associated with each gas.

Although the embodiment 210 illustrated in FIG. 2 utilizes generally dispersed gases within the interior volume 26 and requires no additional mixing structures, the embodiments 310 and 410 differ. For example, as illustrated in FIG. 3, it is necessary to deliver the gas mixture further into the interior volume and to allow it to intermix effectively with the carbon powder 32. For this reason, the deluxe version of gas subassembly 322 is provided with a percolation head 56 situated actually within the graphite container 30 and within the powder bed 34. This facilitates distribution of the reaction gases into the heated carbon powder 32 and speeds up the reaction time. It has been found that adequate reactions occur even without the percolation head 56, but maximum dispersal is a desired goal.

Similarly, in FIG. 4, the gases are mixed and react with the carbon powder 32 in a prereaction vestibule 58 situated outside the reaction chamber 14, to form the carbon-containing reactants to prior being introduced into the chamber 14. The flowing gases 23 react with the hot carbon powder 32 to form carbon-containing reactants 5 (gaseous species) which flow into the reaction chamber 14 and effect the surface treatment of the metal parts 11 which are supported therein by the support structures 28.

The usual reaction gases 23 for the process are provided by a nitrogen source 60, a hydrogen source 62, and a water vapor source 64. Each of the gas sources is provided with an associated source valve 54 to control the flow of the particular reaction gas 23 into the reaction chamber 14. Although the typical gas source is a compressed gas tank for the specific material involved, other structures may be incorporated as well, such as preheating structures and the like.

The vacuum subassembly 18 also acts as an exhaust mechanism for the reaction chamber 14. In addition since the reaction gases 23 may be delivered at elevated pressures, it is desirable in some instances to provide an exhaust vent 66 (see FIG. 3) which is separate from the vacuum subassembly 18. In addition, particularly in the deluxe versions of embodiment 310 and 410, the vacuum line 38 is provided with a particle filter 68 to capture any airborne particles which may result from the carbon powder 32 and to prevent fouling of the other elements, although experience has shown that such filtration is not strictly required.

The embodiment 510 illustrated in FIG. 5 utilizes a different method of delivering the reaction gases 23, at least the nitrogen and hydrogen, into the interior volume 26. In this case, a plasma generator 70 is placed intermediate the sources of the nitrogen and hydrogen (60 and 62) and the reaction chamber 14. The plasma generator 70 acts to convert the molecular hydrogen and nitrogen gases into atomic form (also known as "plasma phase"). It is believed that the reactions involving the hydrogen, nitrogen and carbon will proceed at a higher rate when the hydrogen and nitrogen are delivered to the elemental carbon 17 as atoms (plasma) rather than in their molecular form or gaseous phase, although the overall temperature of the reaction chamber 14 need not be increased to the level where the atomic phase would be the preferred condition.

From a series of experiments, the inventors have determined that carbon is transported from the solid carbon to the metal by a gas species rather than through solid state diffusion, as previously believed. Experimental results indicate that when carbon 17 is heated in a chamber containing nitrogen, along with hydrogen and/or water, the carbon-containing reaction gas species 35 believed to be CN-containing molecules such as cyanogen, $C_2N_2$, and hydrogen cyanide, HCN. Unlike the expectations from the prior art, carbide formation was not seen when hydrogen alone was used as the process gas. The production of CN-containing molecules in significant amounts is not predicted by thermodynamics, making the efficacy of the process entirely unexpected. A carbide layer is formed when the CN-containing molecules react with the metal surface, depositing carbon, which then diffuses into the bulk. Transport of carbon to the metal 11 part occurs at a very slow rate when carbon in the presence of nitrogen is heated to temperatures >800° C. The introduction of hydrogen and/or water to the reaction chamber containing hot carbon and nitrogen accelerates this carbon transport. As a result, the carbon transfer to the metallic part 11 may be easily turned on and off by increasing and decreasing the hydrogen and/or water additions to the nitrogen process gas. Nitrogen is also incorporated into the metal by reducing the partial pressures of water and hydrogen, making a carbonitrided layer. Surface carbon treatment to a depth greater than 30 microns has been achieved using these methods.

An example of utilization of the present method is described herein for the purposes of illustration. For a treatment of a metallic part 11 formed of tantalum, within a reaction chamber 14 such as that illustrated in FIG. 2, the operational parameters would be as follows. The interior volume 26 would be heated to a temperature of 1400° C. after evacuation. Following this, in order to achieve a desired carbide type of surface zone 72, the following partial pressures of reaction gases would be provided: nitrogen 870 torr and 30 torr of $H_2$ or $H_2O$. This mixture would be maintained within the interior volume 26, with the temperature level being continuously maintained for an interval of four hours.

It is expected that similar parameters will be applicable to surface treatments of the other metals within the group and also utilizing the variations on the carbonitride surface treatment system 10. However, it is expected that these will be easily empirically determined for each desired configuration.

In addition to the above examples, various other modifications and alterations of the structures, apparatus, concentrations, orientations and usages may be made without departing from the invention. Accordingly, the above disclosure is not to be considered as limiting and the appended claims are to be interpreted as encompassing the entire spirit and scope of the invention.

INDUSTRIAL APPLICABILITY

The inventive method of providing carbonitride surface treatment to refractory metals of the present invention, and the associated surface treatment systems for accomplishing the method are expected to have substantial utility in a variety of fields. Metallic parts 11 which have been treated according to the inventive method are provided with an exterior surface layer which is substantially improved in its resistance to abrasion, corrosion (oxidation) and heat softening. Surfaces which have been treated according to the present method are harder and better able to hold an edge than untreated surfaces and are thus desirable for such utilizations as cutting tools, aircraft parts, nuclear reactor components and the like. In particular, the inventors are aware of substantial advantages to utilizing treated parts in the applications of high temperature corrosion resistant coatings for petroleum processing.

The present method is adaptable for use in a wide variety of circumstances and with a wide variety of metallic parts 11. Precise process control may be achieved by varying the parameters of temperature and partial pressures of the reaction gases. If it is determined that a certain type of surface treatment is optimal for a particular usage, with a particular type of metal part 11, variations of the reaction parameters may be empirically determined in order to achieve this result.

Because of the utility of producing useful items, the general simplicity of the structures involved, the availability of process materials and the adaptability of the process to a variety of materials and circumstances, is expected that this invention will achieve acceptance in the field. For all of the above reasons, and others not stated herein, it is expected that the present invention will have industrial applicability and market utility which are both widespread and long lasting.

We claim:

1. A method for forming a carbide or carbonitride surface on refractory metals, in steps comprising:

a. selecting a component part formed of a refractory metal, said component part including a surface;

b. placing said component part in a reaction chamber in a manner such that the surface of said component part is not substantially occluded by contact with nonreactive materials;

c. providing a source of elemental carbon to said component part in the vicinity of said reaction chamber;

d. heating said component part and said elemental carbon to a reaction threshold temperature of at least 800° C.; and e. introducing a gas mixture comprising nitrogen and at least one of hydrogen or water vapor to react with said elemental carbon to form a reaction gas mixture;

f. contacting said refractory metal surface with said reaction gas mixture to form a carbide or carbonitride;

g. controlling formation of said carbide by adjusting said hydrogen and/or water vapor concentration in said reaction mixture; and h. preferentially forming the carbonitride layer by decreasing the partial pressure of said hydrogen and/or water vapor in said reaction gas mixture.

2. The method of claim 1 and further including the terminal step of i. finishing said component part by, in indeterminate order, cooling, removing from said reaction chamber and optionally quenching.

3. The method of claim 1 wherein said gas mixture reacts with said elemental carbon to form carbon containing reactants which subsequently react with said surface of the component part.

4. The method of claim 1 wherein said source of elemental carbon is in the form of a graphite container surrounding said component part.

5. The method of claim 1 wherein said source of elemental carbon is in the form of a bed of carbon powder in which said component part is supported.

6. The method of claim 3 wherein said source of elemental carbon is in the form of carbon powder disposed in a prereaction vestibule associated with said reaction chamber, said gas mixture being delivered to the prereaction vestibule such that the carbon containing reactants are subsequently delivered to said reaction chamber.

7. The method of claim 1 wherein the refractory metal is selected from the group including boron, chromium, hafnium, molybdenum, niobium, tantalum, titanium, tungsten and zirconium.

8. The method of claim 1 wherein said gas mixture is delivered to a plasma generator to convert molecular gas components to elemental phase prior to reaction with the elemental carbon.

9. In a method for providing a carbon containing surface layer to a component formed of a refractory metal, the improvement comprising:

reacting nitrogen and at least one of hydrogen or water vapor with elemental carbon to form CN-containing reactants in a gas mixture;

preheating the component to a temperature of at least 800° C., in an evacuated chamber;

contacting the preheated component with the CN-containing reactants to form a carbide or carbonitride surface layer on said metal;

controlling formation of said carbide by adjusting the concentration of said hydrogen and/or water vapor in said gas mixture; and preferentially forming the carbonitride layer by decreasing the partial pressure of said hydrogen and/or water vapor in said gas mixture.

10. The improvement of claim 9 and further including preferentially forming the carbide layer by increasing the partial pressure of hydrogen and/or water vapor in the proximity of the preheated component to increase the rate at which the carbide surface layer is formed.

11. The improvement of claim 16 wherein the hydrogen is provided in the form of water vapor.

12. The improvement of claim 9 further comprising:

preferentially forming the carbide surface layer by increasing the partial pressure of said hydrogen and/or water vapor sufficient to facilitate the reaction of CN-containing reactants with said metal.

13. A method of forming carbide and carbonitride surface regions on a refractory metal component part comprising:

a. placing said component part in a graphite container in a reaction chamber;

b. evacuating said chamber;

c. heating said chamber to a temperature of about 800°–1400° C.;

d. introducing a gas mixture comprising nitrogen gas and at least one of hydrogen gas or water vapor to react with said graphite to form a reaction gas mixture;

e. contacting said refractory metal component with said reaction gas mixture to form a carbide or carbonitride surface;

f. controlling formation of said carbide by adjusting the hydrogen and/or water vapor concentration in said reaction gas mixture; and g. preferentially forming the carbonitride surface by decreasing the partial pressure of said hydrogen and/or water vapor in said reaction gas mixture.

14. A method for providing a carbon containing surface layer to a component formed of a refractory metal, comprising:

providing nitrogen and at least one of hydrogen or water vapor to a source of elemental carbon to form carbon-containing gas species in a reaction mixture;

preheating the component to a temperature of at least 800° C. in an evacuated chamber;

contacting said component with said reaction mixture to form a carbide or carbonitride surface layer on said component;

controlling formation of said carbide by adjusting said hydrogen and/or water vapor concentration in said reaction mixture; and preferentially forming the carbonitride layer by decreasing the partial pressure of said hydrogen and/or water vapor in said reaction mixture.

* * * * *